United States Patent [19]

Schroeder

[11] 4,433,441

[45] Feb. 28, 1984

[54] WATER CLOSET-ODOR NEUTRALIZER

[76] Inventor: Warren C. Schroeder, Gellett Suite C-603 2400 Virginia Ave. NW., Washington, D.C. 20037

[21] Appl. No.: 335,846

[22] Filed: Dec. 30, 1981

[51] Int. Cl.[3] ..... E03D 9/04; A47K 13/00

[52] U.S. Cl. ..... 4/213; 4/217

[58] Field of Search ..... 4/213, 217, 228

[56] References Cited

U.S. PATENT DOCUMENTS

| | | | |
|---|---|---|---|
| 2,172,506 | 9/1939 | Gerger | 4/217 |
| 2,619,655 | 12/1952 | Huff | 1/213 |
| 2,724,840 | 11/1955 | Scott et al. | 4/213 X |
| 3,332,089 | 7/1967 | Wilton | 4/213 |
| 3,491,382 | 1/1970 | Poister | 4/217 |
| 3,534,415 | 10/1970 | Huffman | 4/213 |
| 3,564,624 | 2/1971 | Paley | 4/217 |
| 4,103,370 | 8/1978 | Arnold | 4/213 |
| 4,174,545 | 11/1979 | Smith, Jr. | 4/213 |
| 4,301,555 | 11/1981 | Poister | 4/217 |
| 4,312,082 | 1/1982 | Murphy et al. | 4/228 |

*Primary Examiner*—Henry K. Artis

[57] ABSTRACT

This invention is directed to a chemical aided water closet odor neutralizing device. The odor neutralizing device is located or mounted between the water closet and the water closet seat and is characterized by having a suction cavity on one side of the seat and a pressure chamber on the opposite side, including a chemically saturated filter whereby in operation, a circulating air blanket is created over the bowl combining chemically the escaping gases and thereby neutralizing their offensive odors.

6 Claims, 6 Drawing Figures

WATER CLOSET-ODOR NEUTRALIZER

BACKGROUND OF THE INVENTION

Of the many type of aerosol inventions and water additives none approach the problem of water closet odor control as does this invention. This invention creates, redirects and controls air circulation and odor neutralization within the closet bowl throughout the entire usage of the water closet chemically combining it with the agent.

SUMMARY OF THE INVENTION

THE WATER CLOSET - ODOR NEUTRALIZER chemically combines the air above the water closet bowl with a chemical agent to neutralize the odor. It mounts and seals between the water closet bowl top and the seat.

A motor driven fan circulates the foul air sucked from the bowl through a chemically treated filter wick and back into the bowl, thus neutralizing the circulated air. The circulation being automatically controlled by a micro switch during usage.

Accordingly, it is therefore the object of the present invention to provide a water --odor neutralizer which chemically combines the foul air above the water closet bowl and below the seat with a chemical agent to neutralize the fowl air.

Another object of the present invention is to provide a blanket of air across the toilet bowl opening and below the toilet bowl seat so as to combine therewith a chemical neutralizing agent.

Still another object of the present invention is to circulate the foul air sucked from the water closet bowl through a chemically treated filter wick and back into the water closet bowl via a motor driven fan automatically controlled by a micro-switch during usage or when in the operative position or mode.

DESCRIPTION OF THE PREFERRED EMBODIMENTS

Figure 1:
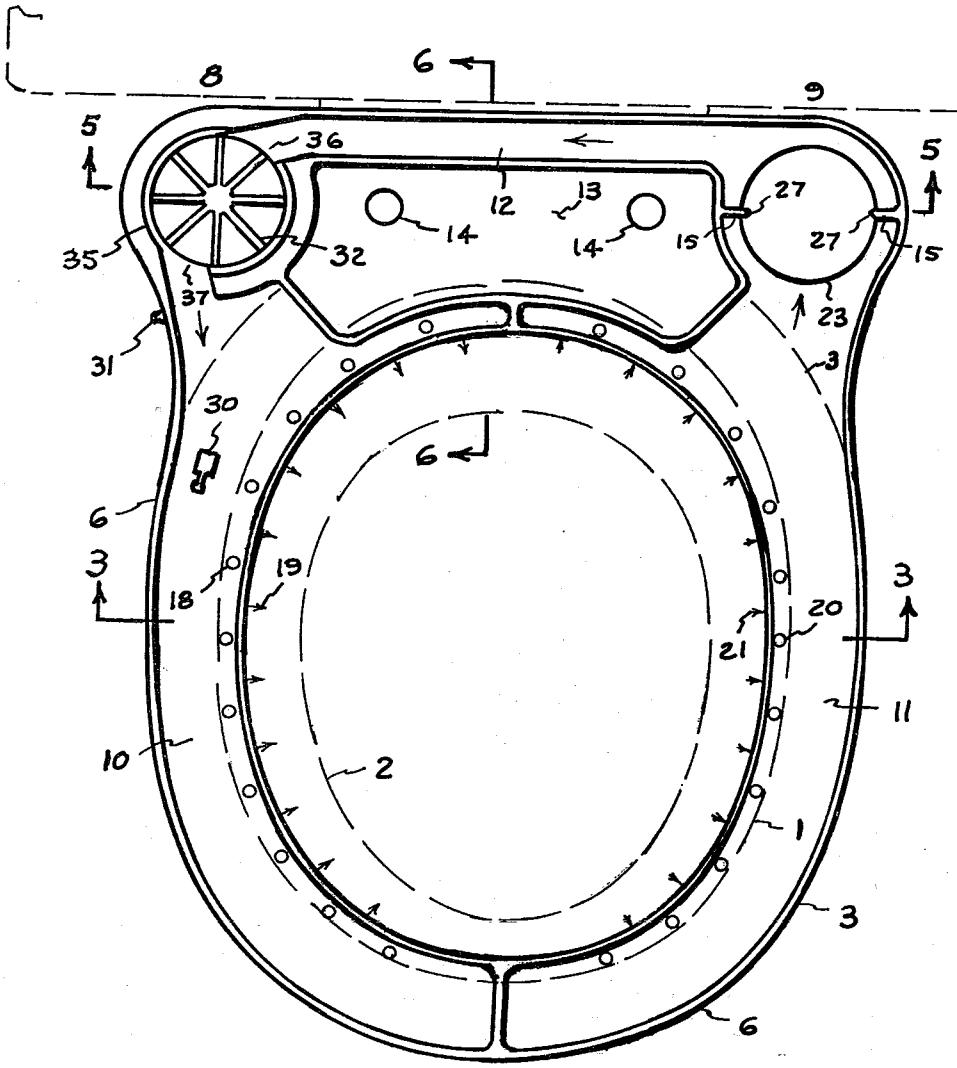
FIG. 1 shows a plan view of the bottom one-half section of the pan and general arrangement of components.

Referring to the drawings, meaning FIGS. 1-6, the assembly, as shown, comprising a water closet bowl having a top characterized by an inside face profile 1, an inside seat profile 3, a water closet tank 4. The assembly is further characterized by a lower pan 6 and upper pan 7 which are fused together to form a two compartment cavity having a configuration likened to the toilet bowl rim. Cavity 10 is the pressure section while cavity 11 is the suction section. The two cavities 10, 11 when fused together are located between the water closet bowl top and the bottom surface of the water closet seat. The two compartment cavity is held in place by the same connection or taps that holds the toilet bowl seat and lid or cover to the water closet bowl via matching bores 14 in lower pan 6. Note that FIG. 1 shows the general arrangement of the operating unit with the upper pan 7 removed. The assembly is moter driven via motor 28. The motor driven fan impeller 32 spins whereby air is sucked from the water closet bowl through holes 20 and 21 in suction cavity 11. The air is sucked through the saturated filter wick 23 and passes through the interconnecting chamber 12, through port 36, the fan input opening and discharged out of the fan output opening 37 into the pressure cavity or chamber 10. It is this circulation of airflow that blankets the upper surface of the closet bowl to permit the chemical union.

The fan motor is controlled by an automatically operated micro switch 30 and is operated continuously as soon as weight is applied to the seat. The micro switch 30 terminates or stops the fan motor 28 and fan impeller 32 when the weight is removed. An optical manuel switch 31 may be used in lieu of micro switch 30.

It is noted that bottom pan 6 is one continuous molded piece with ribs formed therein to make up the various cavities. Moreover, the bottom pan 6 provides the interconnection and mounting means for attaching the motor, fan and filter wick. The area identified as 13 on the bottom pan 6 is a single flat section.

Figure 2:
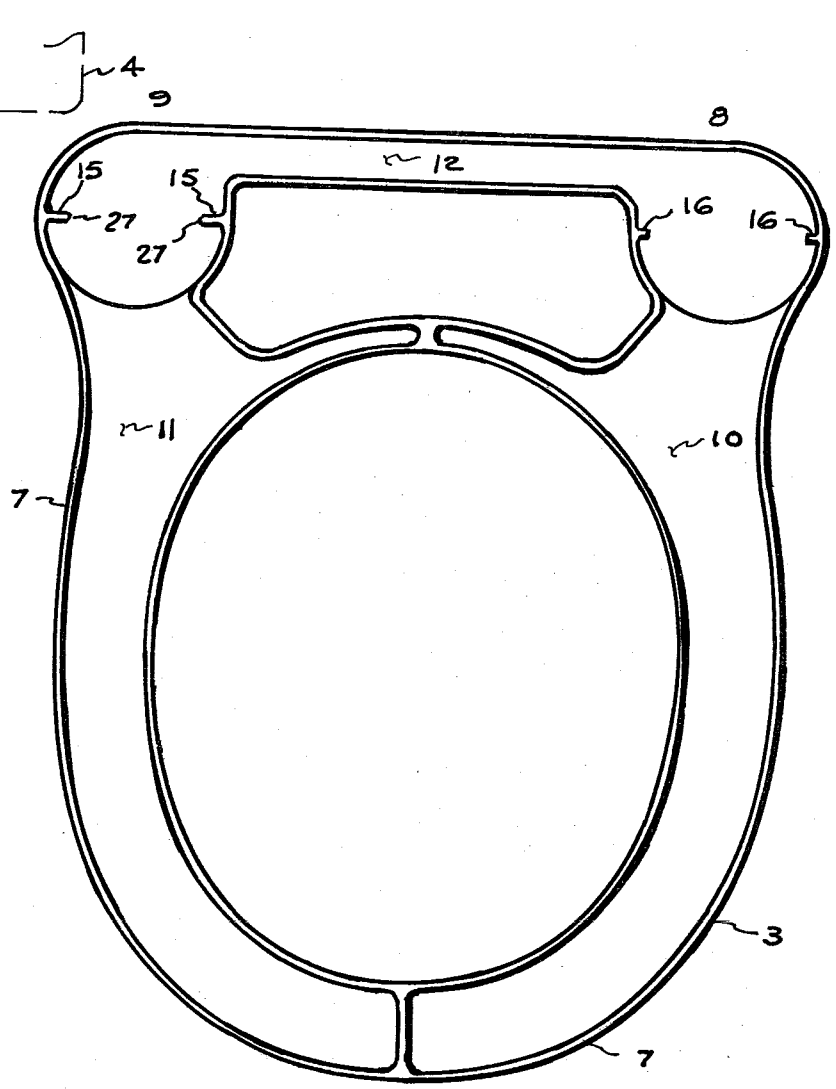
FIG. 2 shows a plan view of the top section of the pan viewing it from the inside out.
Figure 5:
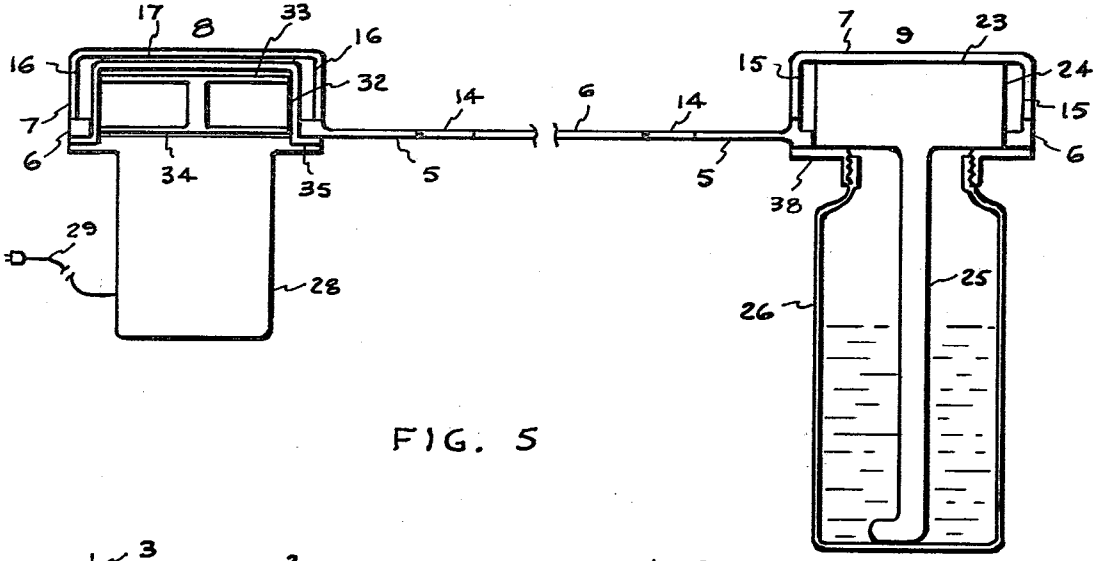
FIG. 5 shows a partial cross section through the fan, filter wick and chemical canister.

FIG. 2 shows a plan view of B a half-section of upper pan 7. It too, is a continuous molded piece. FIG. 5 is a partial cross-sectional view of upper pan 7 taken along line 5—5 of FIG. 1. The fan section is identified by reference numeral 8 and the filter section is identified by reference numeral 9. The upper portion 245 of the filter wick 23 is a circular disc. The lower portion 25 of the filter wich 23 is a stem which protrudes into the liquid chemical agent held in canister 26. Collar 38 screws over canister 26 and is attached to lower pan 6 with a plurality of screws (not shown). This arrangement allows for easy replacement of the filter wick 25, 23.

Figure 6:
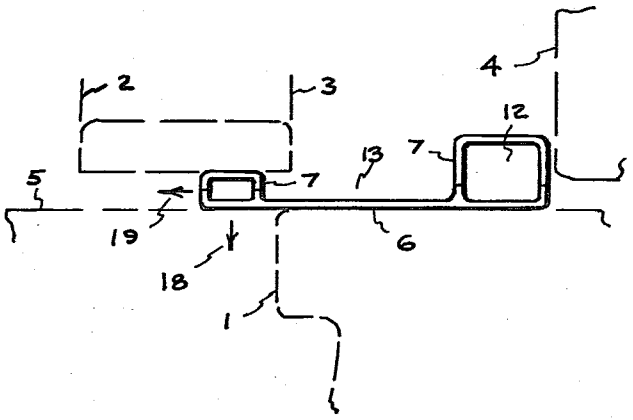
FIG. 6 shows a partial cross section of the installed unit as viewed through the centerline of the rear end of the closet bowl.
Figure 4:
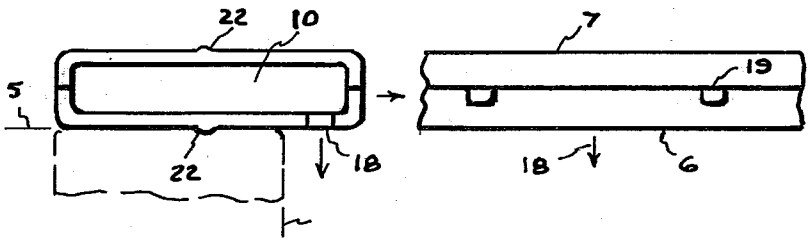
FIG. 4 shows a typical cross section of the pressure cavity.

To complete the seal of the suction cavity 11 with the interconnection chamber 12, ribs 15 are added. The end portions 27 of ribs 15 project into the canister 26 partially to complete the seal, thus forcing the foul air through the chemically saturated filter wick 25, 23 and into the interconnection chamber 12. The electric motor 28, electric plug 29, motor fan housing 35 and fan impeller 32 are fitted to rotate or spin within circular housing 35. Housing 35 is characterized by inlet port 36 and outlet port 37. It should be noted that ribs 16 are added to bottom pan 7 to complete the seal between the interconnection chamber 12 and the pressure cavity 10. Ribs 16 are in contact with the motor fan housing 35. A flexible or soft seal 17 is added to further complete the seal and allow for manufacturing tolerances. FIG. 6 shows the installation and mounting of the unit at the rear of the water closet. This is a partial cross-sectional view of the installed unit taken from FIG. 1 when viewed through the center line of the rear portion of the water closed bowl. The treated air circulation flows via of discharge holes 18 and 19, see FIG. 4.

Bottom pan 6 and upper pan 7 are characterized by a slightly raised rib portion 22. This aids in forming a seal between the components e.g. the water closet bowl rim and the bottom pan 7. Additional ribs and bosses may be added to serve as increase support and reinforcement for the upper pan 6 and bottom pan 7 which constitutes pressure chamber 10 as well as suction chamber 11.

Figure 3:
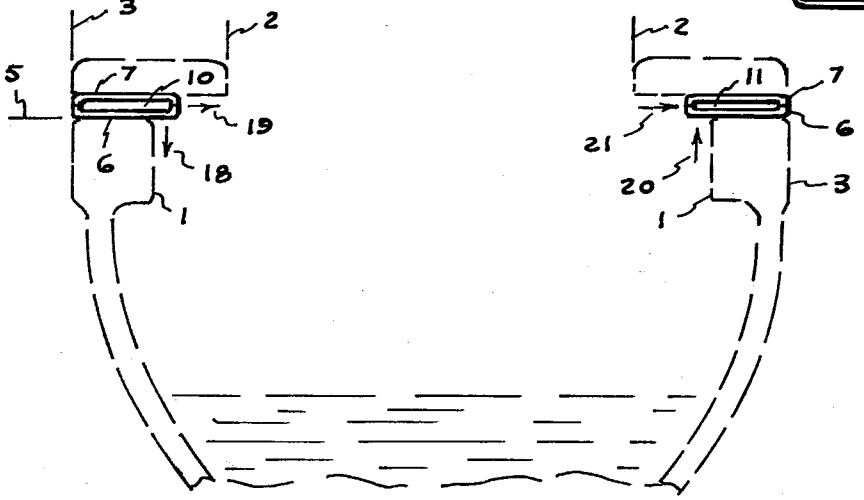
FIG. 3 show a partial cross section of the installed unit with the closet and seat.

Discharge holes 18, 19 and suction holes 20, 21 are shown as being horizontal and vertical relative to the water closet bowl rim, see FIG. 3, respectively, however the holes may be formed in the vertical direction only.

Upon installation, the existing bosses on the toilet seat, may be removed or the upper pan 7 may be fabricated with depressions at these locations and optionally the motor 28 may be mounted above the toilet bowl rather than extend below the toilet bowl as shown, see FIG. 5.

It will of course be understood by those skilled in the art the particular embodiments of the invention here shown are by way of illustration only, and are meant to be in no way restrictive; therefore, numerous changes and modifications may be made and the full use of equivalents resorted to, without departing from the spirit or scope of the invention as defined by the appended claims.

I claim:

1. In combination with a toilet unit having a water closet bowl, a seat pivotally connected thereto, a water closet tank having a cover therefor and a discharge conduit means including a trap communicating with said water closet bowl at one end and adapted for connection to a sewage pipe at the opposite end, a chemically aided water closet odor neutralizing device comprising an air chamber means mounted on top of the water closet bowl rim positioned between said seat and said bowl, said air chamber means having a pressure cavity on one end of said water closet bowl and having a plurality of holes spaced around the interior thereof to discharge a blanket of air across the upper portion of said water closet bowl opening, a suction cavity on the other side of said water closet bowl opening opposite said pressure cavity and having a plurality of holes spaced around the interior thereof receiving the blanket of air discharged from the for pressure cavity, said blanket of air passing through said suction cavity, said suction cavity means whereby the air passing threthrough passes through a chemically saturated filter, said filter having means to supply it with liquid chemicals from a canister attached thereto, means providing a suction chamber whereby said air is passed through said chamber by way of port means and into a motorized fan having a housing therefor, said motorized fan directing the air by way of second port means back into said pressure cavity for recirculating the blanket of air across said bowl opening for recycling; electric switch means within said pressure cavity for activating said fan and motor therefor.

2. The combination according to claim 1, wherein said filter is a disc filter wick, said disc filter wick extends within and to the bottom most portion of said canister.

3. The combination according to claim 1 whereby the motorized fan housing separates the suction cavity from the pressure cavity.

4. The combination according to claim 3 wherein the fan housing, fan and motor are cylindrical in configuration and replaceable as a unit.

5. The combination according to claim 2 wherein said disc filter wick is replaceable.

6. The combination according to claim 1 wherein sealing means is provided to prevent the escape of air withing the water closet odor neutralizing device.

* * * * *